US010161672B2

(12) United States Patent
Cizik et al.

(10) Patent No.: US 10,161,672 B2
(45) Date of Patent: Dec. 25, 2018

(54) DOMESTIC REFRIGERATION APPLIANCE HAVING A MULTIPART SUPPORT CAGE FOR A FOOD RECEIVER-CONTAINER

(71) Applicant: BSH HAUSGERAETE GMBH, Munich (DE)

(72) Inventors: Herbert Cizik, Ottenbach (DE); Jessica Dittmann, Lauchheim (DE); Andrea Fink, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/728,933

(22) Filed: Oct. 10, 2017

(65) Prior Publication Data

US 2018/0100688 A1 Apr. 12, 2018

(30) Foreign Application Priority Data

Oct. 12, 2016 (DE) ..... 10 2016 219 880

(51) Int. Cl.
*F25D 25/00* (2006.01)
*F25D 25/02* (2006.01)
(Continued)

(52) U.S. Cl.
CPC ..... *F25D 25/025* (2013.01); *A47B 88/477* (2017.01); *A47B 88/483* (2017.01); *F25D 17/042* (2013.01); *F25D 23/067* (2013.01); *F25D 25/005* (2013.01); *A47B 2210/07* (2013.01); *A47B 2210/175* (2013.01); *F25D 2317/0413* (2013.01)

(58) Field of Classification Search
CPC .... F25D 25/025; F25D 25/005; F25D 23/067; A47B 88/483; A47B 2210/175
See application file for complete search history.

(56) References Cited

U.S. PATENT DOCUMENTS 7,721,852 B2 5/2010 Choi et al.
9,677,806 B2 6/2017 Bischofberger et al.
(Continued)

FOREIGN PATENT DOCUMENTS

CN 203405053 U 1/2014
DE 4040341 C2 5/1994
(Continued)

*Primary Examiner* — Daniel J Rohrhoff
(74) *Attorney, Agent, or Firm* — Laurence A. Greenberg; Werner H. Stemer; Ralph E. Locher

(57) ABSTRACT

A domestic refrigeration appliance has a receiver space for food, which is defined by walls of an internal container. An extension device is arranged on the internal container and is able to be pushed into and pulled out of the receiver space relative to the internal container. A container for receiving food is able to be removably positioned on the extension device. The extension device has a support cage for the container which, viewed in the width direction of the domestic refrigeration appliance, has a base plate and retaining elements arranged thereon on opposing sides and separate from the base plate as lateral cage walls. The retaining elements are configured as suspension elements for the releasable suspension in a non-destructive manner of the support cage on extension rails of the extension device) separate from the support cage.

15 Claims, 15 Drawing Sheets

(51) Int. Cl.

| | |
|---|---|
| ***A47B 88/477*** | (2017.01) |
| ***A47B 88/483*** | (2017.01) |
| ***F25D 17/04*** | (2006.01) |
| ***F25D 23/06*** | (2006.01) |

(56) References Cited

U.S. PATENT DOCUMENTS

| | | | | |
|---|---|---|---|---|
| 2010/0090575 | A1 | 4/2010 | Uthuppan | |
| 2013/0264928 | A1* | 10/2013 | Hong | F25D 25/025 312/404 |
| 2015/0316314 | A1* | 11/2015 | Bassler | F25D 25/025 312/408 |
| 2017/0234607 | A1* | 8/2017 | Yang | A47B 88/453 312/408 |
| 2017/0350642 | A1* | 12/2017 | Yang | F25D 25/025 |
| 2017/0367480 | A1* | 12/2017 | Dickerson | A47B 88/45 |
| 2018/0038632 | A1* | 2/2018 | Yang | F25D 25/025 |
| 2018/0100686 | A1* | 4/2018 | Cizik | F25D 25/005 |
| 2018/0100689 | A1* | 4/2018 | Gatter | A47B 88/477 |

FOREIGN PATENT DOCUMENTS

| | | | |
|---|---|---|---|
| EP | 2564729 | A1 | 3/2013 |
| GB | 2417671 | A | 3/2006 |
| JP | H0735469 | A | 2/1995 |
| JP | 2006162106 | A | 6/2006 |
| WO | 2011026749 | A2 | 3/2011 |

* cited by examiner

DOMESTIC REFRIGERATION APPLIANCE HAVING A MULTIPART SUPPORT CAGE FOR A FOOD RECEIVER-CONTAINER

CROSS-REFERENCE TO RELATED APPLICATION

This application claims the benefit, under 35 U.S.C. § 119, of German patent application DE 10 2016 219 880.7, filed Oct. 12, 2016; the prior application is herewith incorporated by reference in its entirety.

BACKGROUND OF THE INVENTION

Field of the Invention

The invention relates to a domestic refrigeration appliance having a receiver space for food which is defined by walls of an internal container, an extension device which is arranged on the internal container and which is able to be pushed into and pulled out of the receiver space relative to the internal container, and a container for receiving food which is able to be removably positioned on the extension device.

Such an embodiment is disclosed, for example, in published European patent application EP 2 564 729 A1. Here the extension device is simply formed by telescopic extensions arranged on opposing vertical side walls of the internal container. A drawer which is able to be positioned on these telescopic extensions engages with a rear tab in the coupling element which has a convex portion. In a front region of the drawer a hole is configured on a web protruding laterally from a vertical side wall of the drawer, a through-pin which is arranged on the running rail of the telescopic extension passing therethrough when the drawer is positioned on the telescopic extensions. The through-pin and the rear coupling element are both configured on the running rail of a telescopic extension and in the positioned state the drawer is fixed in position on the running rail and thus arranged thereon in an accurately fitting manner. In such an embodiment, the removal of the drawer from the running rail is more difficult due to the accurate fit and is associated with a corresponding expenditure of force. The same applies to the positioning of the drawer onto these telescopic extensions. In addition to the difficult positioning and removal, damage to the coupling elements may also occur and/or increased wear may occur as a result.

Containers in very different embodiments are known. They may be simple drawers which are open and in which the same ambient humidity always prevails as in the remaining receiver space. Moreover, keep-fresh containers for food are known in domestic refrigeration appliances in which an ambient humidity which is different from the receiver space and/or a different degree of humidity is able to be adjusted and this may be implemented separately from the remaining receiver space. To this end, the domestic refrigeration appliance generally contains a humidifying device, a fluid mist which may be introduced directly into the storage region and/or the keep-fresh container being able to be produced thereby. The humidifying device contains in the known manner a tank with water from which via a misting unit, for example a piezo element, the fluid mist is produced from the water. The fluid mist then being directly conducted into the keep-fresh container by a fan via a line connection and separately from the receiver space. The keep-fresh container is displaceably arranged in a housing of the domestic refrigeration appliance. Such embodiments are known from the prior art.

Moreover, international patent disclosure WO 2011/026749 A2, corresponding to U.S. Pat. No. 9,677,806, discloses a corresponding refrigeration appliance having a vegetable compartment. A drawer for receiving the vegetables may be introduced into and removed from the interior. This drawer is able to be covered from above by a cover. The cover in the closed state bears against obliquely configured upper edges of the drawer. Above the cover a further plate is arranged, a front strip being configured thereon and an operating element being movably positioned on the front strip. The operating element may be displaced parallel to the front strip and to this end is coupled to an obliquely extending guide track in the form of a slot which is configured in the cover. Depending on this displacement of the slider, the cover is then lifted, the cover being coupled via a corresponding mechanical coupling to the plate arranged thereabove.

Moreover, a keep-fresh box with a closable cover is disclosed in German patent DE 40 40 341 C2. This box is also able to be introduced into an interior of a domestic refrigeration appliance.

In both embodiments known from the prior art it is provided to protect the refrigerated goods introduced therein, for example in the form of vegetables, salad, meat, fruit and the like, from drying out in an undesirably rapid manner. The problems occurring in this connection have already been sufficiently described in DE 40 40 341 C2.

SUMMARY OF THE INVENTION

It is the object of the present invention to provide a domestic refrigeration appliance in which a positioning of a container on an extension device and the handling of the container is improved when removing from or positioning onto the extension device.

A domestic refrigeration appliance according to the invention has a receiver space for food, which is defined by walls of an internal container. The domestic refrigeration appliance also has an extension device which is arranged on the internal container and which is able to be pushed into and pulled out of the receiver space relative to the internal container. This is carried out in the depth direction of the domestic refrigeration appliance. Moreover, the domestic refrigeration appliance has a container which is configured separately from the extension device and which is configured for receiving food. The food receiver-container is able to be removably positioned on the extension device so that it is releasably arranged there in a non-destructive manner. Thus the container may be removed from the extension device and repositioned there in a reversible manner.

An essential idea of the invention is to provide the extension device with a support cage for the container which, viewed in the width direction of the domestic refrigeration appliance, has a base plate and retaining elements which are arranged thereon on opposing sides and separate from the base plate as lateral cage walls. The retaining elements are configured as suspension elements for the releasable suspension in a non-destructive manner of the support cage on extension rails of the extension device which are separate from the support cage. As a result, a stable reception of one or more containers is possible so that a positionally secure arrangement of the container both in the unloaded and in the loaded state is also permitted. In the unloaded state in which the container has a low weight, it is securely positioned, even in the case of abrupt displacement of the extension device. In the loaded state, a construction is provided by the support cage which has a high load-bearing capacity and which is also able to bear the weight and yet a smooth displacement movement of the extension device is achieved. By the individual design of the support cage, however, full accessibility to the container is always achieved even in the extended state, so that the handling of the container is simple and user-friendly.

The support cage may also be denoted as a support groove or support seat.

The base plate may, in particular, be a tray.

In particular, viewed in the depth direction of the domestic refrigeration appliance, the support cage is configured so as to be open to the rear. As a result, the accessibility to the container is further improved and the weight of the support cage is reduced.

In particular, the base plate is releasably connected in a non-destructive manner to the retaining elements. By this ability to be dismantled, the base plate may be easily cleaned in its individual parts.

In particular, the base plate is connected to the retaining elements by interlocking plug connections. These connections are mechanically stable and permit particularly simple dismantling and assembly.

In particular, in each case the retaining elements have a supporting web, the base plate being positioned thereon. As a result, a mechanically stable positioning of the base plate is achieved and yet the constructional space is not undesirably limited.

Preferably, at least one supporting web contains at least one receiver, a coupling element penetrating therein for connecting to the retaining element, the coupling element, in particular, being configured on a lower face of the base plate. Preferably the receiver is a through-hole, in particular with an angled hole contour. In particular, the coupling element is configured for insertion into the receiver with an accurate fit.

In particular, the base plate is of multipart configuration and contains a support plate and carrier rails which, viewed in the width direction of the domestic refrigeration appliance, are connected to the support plate on opposing sides of the support plate. As a result, the base plate is able to meet the different requirements at different points and thus, on the one hand, permit a stable connection with further components of the extension device and, on the other hand, permit the container to be securely received. As a result, the stability of the extension device is high, in particular in the region in which the container is installed. Moreover, the degree of modularity is high and easy handling is provided for dismantling and assembly. Thus the individual parts of the base plate and the extension device may be of a simple type and may be individually cleaned. Due to the smaller parts, these parts may also be placed in a dishwasher.

On its rear region the container preferably contains a coupling element which engages in a coupling recess configured on the extension device when the container is arranged on the extension device. A tilt protection device is configured for the container by the coupling element and the coupling recess, so that in its storage position attached to the extension device the container is not able to tilt about an axis oriented in the width direction of the domestic refrigeration appliance. An undesired tilting of the container is thereby avoided.

It is preferably provided that a storage position of the container, in which the container is positioned on the extension device, is configured with the capacity for a defined movement with clearance relative to the extension device, viewed in the depth direction of the domestic refrigeration appliance. This means that in this storage position, which is also predetermined in a defined manner, the container is not fixed in position and thus is also not arranged in an accurately fitting manner on the extension device but a possible relative movement is still provided between the drawer and the extension device even in this storage position. The tilt protection device is configured such that the coupling element extends into the coupling recess over the entire path of this capacity for relative movement. This also means, therefore, that a tilting of the container is prevented over this entire freedom of movement in the storage position. By such an embodiment, therefore, an easier removal and insertion of the container from the extension device and/or into the extension device is achieved and yet undesired tilting is prevented in all extended positions of the extension device.

In particular, it is preferably provided that an extension stop element is configured on the extension device, the container being limited thereby at the front in its ability to move relative to the extension device. The clearance in the depth direction is limited at the front by the extension stop element. As a result, an undesired further movement to the front of the container relative to the extension device is avoided. An undesired uncoupling of the tilt protection device is thereby prevented.

Preferably, the clearance is less than 1.5 cm, in particular between 0.5 cm and 1.5 cm.

In particular, it is preferably provided that a stop is configured on the container, the stop being configured for contact with the extension stop element in the case of a movement of the container relative to the extension device, viewed in the depth direction of the domestic refrigeration appliance. A very simple embodiment for preventing a movement of the container undesirably far to the front relative to the extension device is thereby achieved in a reliable and robust manner.

Preferably, it is provided that the stop is configured as a runner on a lower face of the container. As a result, an increased mechanical stability of the stop is achieved per se and also a greater attachment surface with the container and/or the lower face thereof is achieved. Also, correspondingly larger forces, which may occur when correspondingly struck, may be absorbed thereby. In particular, this runner extends in the depth direction of the domestic refrigeration appliance. It extends downwardly from the lower face of the container viewed in the vertical direction. It may be provided that the stop which is configured as a runner extends over at least half, preferably at least two thirds, of the extent of the lower face of the container viewed in the depth direction. Preferably, the stop ends with its front end, viewed in the depth direction, set back to the rear relative to a front end of the lower face of the container and/or a base of the container. Preferably, the front end of the stop is set back to the rear by at least a fifth of the extent of the lower face in the depth direction of the domestic refrigeration appliance relative to the front end of this lower face.

In a further advantageous embodiment, it is preferably provided that the coupling element is configured to be integrated in this stop and thus is configured in one piece with the stop. As a result, a very stable component per se may be provided and in addition it is also possible that the coupling element is configured so that a particularly advantageous and reliable coupling in the coupling recess is permitted from a very exposed point, namely in particular from a rear end of the stop protruding in the depth direction to the rear. Also, with such an embodiment the coupling element may also be configured to be relatively small, for example it may be configured as a coupling stud which then may also engage in the manner of a pin in the coupling recess. A solution which is minimized in terms of constructional space is provided thereby. Moreover, by this embodiment of the integrated arrangement of the coupling element in the stop an aligned positioning between the extent of the stop in the depth direction and the coupling element extending further to the rear in the depth direction is also achieved.

In particular, it is preferably provided, viewed in the vertical direction of the domestic refrigeration appliance, which in the storage position of the container this stop is spaced apart from the extension device by a lower edge and thus is arranged without contact relative to this extension device. As a result, an embodiment having very low friction is achieved since the stop does not slide with its lower edge along the extension device.

This is particularly advantageous when the container is installed at different points on other components of the extension device and is able to slide correspondingly along the extension device. For example, the container may be installed to slide directly on a support plate. Additionally and alternatively thereto, it may also be provided that on its vertical side walls the container is brought into contact with guide elements and is positioned there, wherein the guide elements, for example, may be components of retaining brackets and/or retaining elements which in turn are connected, for example, to a door of the extension device, in particular are arranged on an inner face of this door of the extension device.

In an alternative embodiment, however, it may also be provided that this stop is positioned with the lower edge in contact with the extension device, which is possible when a support plate on which the container may be installed in direct contact therewith is not configured.

Preferably, it is provided that the extension device comprises a sliding guide which is configured to be at least open upwardly, wherein in the storage position of the container on the extension device a stop which is configured on the container is engaged from above and is guided in the sliding guide. By this design a very simple and expedient positioning and removal of the container onto and/or from the extension device is achieved and yet also in the storage position a reliable guidance is permitted via the clearance configured in a defined manner in the depth direction. Moreover, an undesired offset of the container relative to the extension device, viewed in the width direction of the domestic refrigeration appliance, is also prevented by the sliding guide.

In particular, the sliding guide is not only configured to be open upwardly but is also configured to be open toward a vertical wall of the internal container. The aforementioned advantages are further improved thereby.

In particular, the sliding guide contains a web and/or a sliding guide wall extension in the depth direction. The stop on the container, viewed in the width direction of the domestic refrigeration appliance, is arranged further to the outside and thus further toward the vertical side wall of the internal container than this sliding guide wall.

In particular, it is preferably provided that the coupling recess is integrated in this sliding guide, in particular configured and correspondingly integrated as a rear end of the sliding guide. Thus the coupling recess is advantageously multifunctional and therefore components are saved. The sliding guide wall, in particular, merges with the walls defining the coupling recess.

In a further advantageous embodiment, it is preferably provided that the extension stop element is integrated in the sliding guide, in particular as a front end of the sliding guide. Moreover, the number of components is minimized thereby and the sliding guide is also configured to be more mechanically stable per se. The sliding guide wall merges, in particular, with the stop.

By the positional arrangement of the coupling recess and the extension coupling element, in view of the integration into the sliding guide, the configuration of the clearance defined in the depth direction is also precisely predetermined and at the same time defines the sliding guide in its dimensions and in its functionality.

In particular, it is preferably provided that the extension device contains at least one carrier rail, the coupling recess being configured thereon. The carrier rail, in particular, is an elongated component which is preferably made of plastics and which is configured in one piece. The coupling recess is configured to be integrated on an upper face of this rail, therefore, so as to protrude upwardly in a convex manner. In particular, a sliding guide for guiding the container is configured with the integrated coupling recess in this carrier rail. Moreover, as a result, the number of components may be reduced, assembly costs and assembly tolerances may be avoided, and a simple and cost-effective component may be produced, in particular as an injection-molded component.

Preferably, it is provided that the extension device contains two such separate carrier rails, in each case corresponding coupling recesses being configured thereon on opposing sides, in particular with corresponding sliding guides, so that in each case coupling elements which are configured on opposing sides of the container may engage in the coupling recesses.

In a particularly advantageous embodiment, it is preferably provided that in addition to these carrier rails the extension device also contains a support plate which is arranged between the carrier rails and is connected to these carrier rails. These carrier rails thus also form on opposing sides edge protection covers and/or impact protection elements for the support plate, which in particular may be made of glass. As a result, a base element and/or a base plate which has a large surface and yet is thin in the vertical direction is provided, the at least one container being able to be installed securely thereon. Specifically by this multipart base plate, the support plate may be configured from a single material, in particular from glass, and nevertheless the at least one coupling recess, the at least one sliding guide and the at least one extension stop element may be integrated in a mechanically stable and simple manner into a separate component of the base plate, namely a carrier rail.

The extension device contains in this connection, in particular, an already cited support plate, the container in its storage position being installed thereon. In particular, in such an embodiment the container contains on its lower face at least one positioning runner which in the storage position of the container on the extension device is positioned directly on an upper face of this support plate and is in contact with this upper face. The positioning runner is integrally formed on the lower face and extends in the depth direction. Preferably two such positioning runners are formed.

In one advantageous embodiment, it is preferably provided that, in its storage position on the extension device, the container is arranged so as to protrude to the front relative to the carrier rail and/or relative to the support plate, viewed in the depth direction of the domestic refrigeration appliance. This is a very advantageous design since, therefore, a desired air circulation may take place in the receiver space which is not interrupted and/or hindered by the carrier rail and the support plate in this front region of the container. Therefore, this air flow may also directly flow unhindered onto this front region of the container and flow past said region so that a desired circulation of the airflow is also achieved in the receiver space and this airflow is not braked or interrupted at this transition point between the carrier rail and/or the support plate, on the one hand, and the container, on the other hand. A particularly advantageous cooling is thereby achieved in the receiver space and thus also in the container.

It is also particularly advantageous if the extension device additionally has holders and/or retaining elements which are separate from the support plate and the carrier rails and which, in particular, are plate-shaped angled components and extend in the manner of a rail in the depth direction of the extension device. In particular, in each case these retaining elements are integrally formed in one piece from metal. They are, in particular, suspension elements, the support plate and the carrier rails being suspended thereby on at least one extension rail of the extension device.

An extension rail is, in particular, a telescopic extension which contains a fixed rail and at least one running rail which is connected thereto and movable relative thereto. The fixed rail is fastened, in particular, to an inner face of a vertical side wall of the internal container. The extension rail is a separate component from the retaining element.

By means of the support plate, the carrier rails and the retaining elements, which are connected to the base plate in the width direction on opposing sides of the base plate, in particular are connected to the carrier rails, a support cage for at least one container is formed from these components. The support cage is laterally defined by the retaining elements which due to their plate shape also form side walls of the support cage. The support cage is configured to be open in the depth direction to the rear. The support cage is hooked into and/or hooked onto the aforementioned extension rails which contain the retaining elements and which are separate from the support cage.

In one advantageous embodiment, it is preferably provided that the extension device is configured as an extending carriage which has a door, door brackets and/or holders being arranged thereon and protruding in the manner of rails to the rear on an inner face of the door facing the receiver space. The door brackets and/or holders are, in particular, the aforementioned retaining elements of the support cage. The container is therefore mounted, in particular indirectly mounted, on these holders. This means that separate further components are also present in addition to the holders, in particular the carrier rails and/or the support plate, the container being directly coupled thereto and being indirectly coupled to the holders via these carrier rails and/or the support plate. Preferably, therefore, the domestic refrigeration appliance also has a tray and/or a type of shelf which contains the aforementioned carrier rails and the support plate. The door of the extending carriage is a front wall which in the closed state of the extending carriage represents a front outer part of the domestic refrigeration appliance.

In a further advantageous embodiment, it is preferably provided that a gap is formed between the inner face of the door and a front end of the carrier rails facing the inner face of the door and/or the support plate. The aforementioned advantages with regard to the unhindered throughflow of the airflow are also promoted thereby in this particular embodiment with an extending carriage.

In particular, it is preferably provided that the container has a step on at least one vertical side wall so that an upper wall portion of the vertical side wall, viewed in the vertical direction of the domestic refrigeration appliance, is offset outwardly relative to a lower wall portion of this vertical side wall, viewed in the width direction of the refrigeration appliance. As a result, a flat bearing surface is provided on the vertical side wall by which the container may be positioned from above onto a bearing part and/or a guide element. For example, this guide element may be the aforementioned rail-type holder and/or the retaining element of the support cage.

In the embodiment of the extension device as an extending carriage the door is a front terminal part which in the closed state of the extending carriage represents an outer part of the domestic refrigeration appliance. In the closed state of the extending carriage and thus the fully retracted state of the extending carriage, the receiver space is closed on the front face by the door.

The container is preferably configured as a drawer so that it is a trough-like component and only accessible from above. However, it may also be configured as a keep-fresh container. To this end it contains, in particular, a drawer and a cover by which the drawer is closable. The cover is able to be lifted and lowered via an actuating mechanism, whereby depending on the position of the cover, humidity may escape from the keep-fresh container or may be trapped therein. By the introduction of fluid mist via a humidifying device described in the introduction, the degree of humidity in the keep-fresh container may be adjusted independently of the remaining volume of the receiver space.

By the terms "above", "below", "front", "rear", "horizontal", "vertical", "depth direction", "width direction", "vertical direction", etc., the positions and orientations are provided for the intended use and intended arrangement of the appliance and with an observer standing in front of the appliance and looking in the direction of the appliance.

Further features of the invention are disclosed from the claims, the figures and the description of the figures. The features and combinations of features cited above in the description and the features and combinations of features cited hereinafter in the description of the figures and/or shown solely in the figures are not only able to be used in the respectively specified combination but also in other combinations without departing from the scope of the invention. Therefore embodiments of the invention which are not explicitly shown and explained in the figures but are disclosed and able to be produced by separate combinations of features from the described embodiments are also regarded as encompassed and disclosed. Embodiments and combinations of features which do not have all of the features of an originally formulated independent claim are also to be regarded as disclosed. Moreover, embodiments and combinations of features which depart or deviate from the combinations of features shown in the back references of the claims are to be regarded as disclosed, in particular by the embodiments set forth above.

Other features which are considered as characteristic for the invention are set forth in the appended claims.

Although the invention is illustrated and described herein as embodied in a domestic refrigeration appliance having a multipart support cage for a food receiver-container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
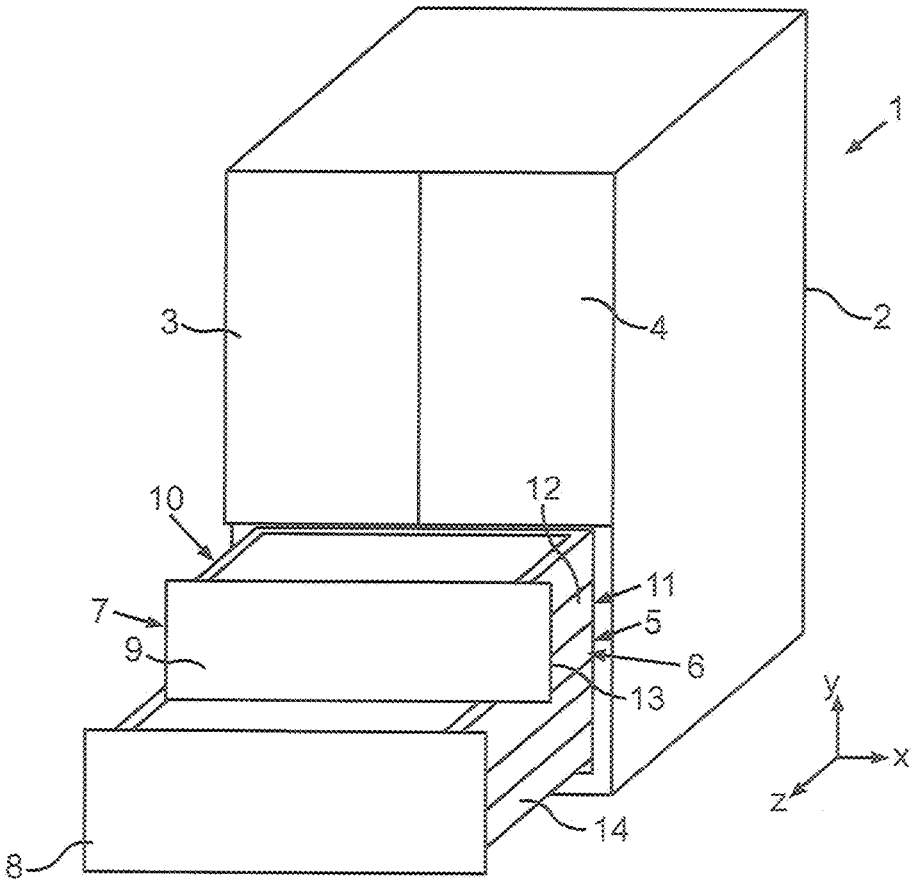
FIG. 1 is a diagrammatic, perspective view of an exemplary embodiment of a domestic refrigeration appliance according to the invention.

In the figures, elements which are the same or functionally the same are provided with the same reference numerals.

Referring now to the figures of the drawings in detail and first, particularly to FIG. 1 thereof, there is shown in a simplified view a domestic refrigeration appliance 1 which is configured for storing and conserving food. The domestic refrigeration appliance 1 in the exemplary embodiment is a combined refrigeration-freezer appliance but may also be a refrigeration appliance or a freezer appliance alone.

The domestic refrigeration appliance 1 contains a housing 2 in which an internal container is configured, the internal container defining by means of walls a first receiver space for food, which on the front face is closable by at least one door, in the exemplary embodiment two separate doors 3 and 4. The doors 3 and 4 are pivotably arranged on the housing 2 and may be pivoted outwardly independently of one another. The pivoting in this case is permitted about a vertical axis and thus about an axis in the vertical direction (y-direction).

The receiver space which is closable by the preferably two doors 3 and 4 in the exemplary embodiment is a refrigeration compartment.

Moreover, the domestic refrigeration appliance 1 contains a further internal container 5 which defines by means of its walls a further second receiver space 6 which is separate from the first receiver space and which in this case is a freezer compartment. In the exemplary embodiment it is provided that in the second receiver space 6 a first extending carriage 7 may be pushed in and pulled out in the depth direction and thus in the z-direction of the domestic refrigeration appliance 1. In particular, in the exemplary embodiment it is provided that the domestic refrigeration appliance 1 contains a second extending carriage 8 which in a corresponding manner may be pushed into and pulled out of the receiver space 6.

The following description is disclosed with reference to the first extending carriage 7. The embodiments may advantageously also apply to the second extending carriage 8. The extending carriages 7 and 8 are extension devices of the domestic refrigeration appliance 1.

The first extending carriage 7 contains a door 9 which represents a front wall and thus also a front terminal part and thus also an external part of the domestic refrigeration appliance 1. The first extending carriage 7 also has a food receiver-container which in this case is a drawer 10 which is thus configured as a trough-like container and is arranged for loading with food or for removing food from above. The extending carriage 7 also preferably contains on opposing sides extension rails 11 which in each case are arranged with a fixed rail on an inner face of vertical side walls of the internal container 5 and also in each case have at least one running rail. The extension rails 11 are therefore in particular telescopic extensions. The extension rails 11 are arranged on opposing sides of the drawer 10. In particular, in the exemplary embodiment it is provided that the first extending carriage 7 has rail-like holders and/or retaining elements 12, wherein in FIG. 1 only the right-hand rail-like retaining element 12 may be seen, when viewed from the front, which is fastened to an inner face 13 of the door 9 facing the second receiver space 6. These rail-like retaining elements 12 are door brackets which are preferably connected to the running rails. They are configured as plate-like and partially angled components made of metal. In each case they are suspended from above on a running rail of an extension rail 11.

Figure 2:
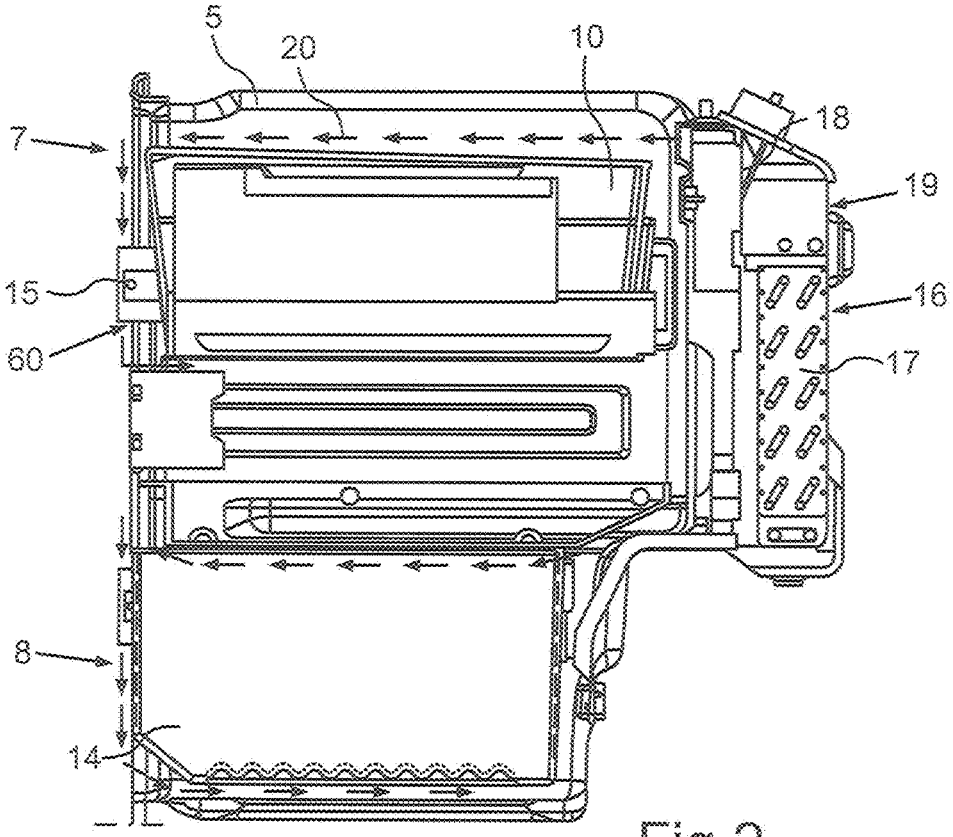
FIG. 2 is a simplified sectional view of the domestic refrigeration appliance according to FIG. 1 in the region of a freezer compartment.

In FIG. 2 the region of the domestic refrigeration appliance 1 is shown in a simplified sectional view which shows the receiver space 6 with the extending carriages 7 and 8. It may be identified that the door 9 and the door of the second extending carriage 8 are not shown. A further container for food as a second drawer 14 which is assigned to the second extending carriage 8 is also shown in FIG. 2. Both extending carriages 7 and 8 are shown in the fully pushed-in state. The view in FIG. 2 is a view in the negative x-direction and thus in the width direction of the domestic refrigeration appliance 1 so that in FIG. 2 a further rail-like retaining element 15 opposing a rail-like retaining element 12 may be identified.

Moreover, it may also be identified that in the exemplary embodiment it is provided that in the freezer compartment and/or the second receiver space 6 cooling energy is introduced through a module 16 which, in particular, has an evaporator 17 and a fan 18 and which is preferably arranged in a separate housing 19. Cooling energy is produced by the evaporator 17 via this unit which represents a refrigeration device, the cooling energy then being circulated as airflow 20 by the fan 18 in the receiver space 6.

Figure 3:
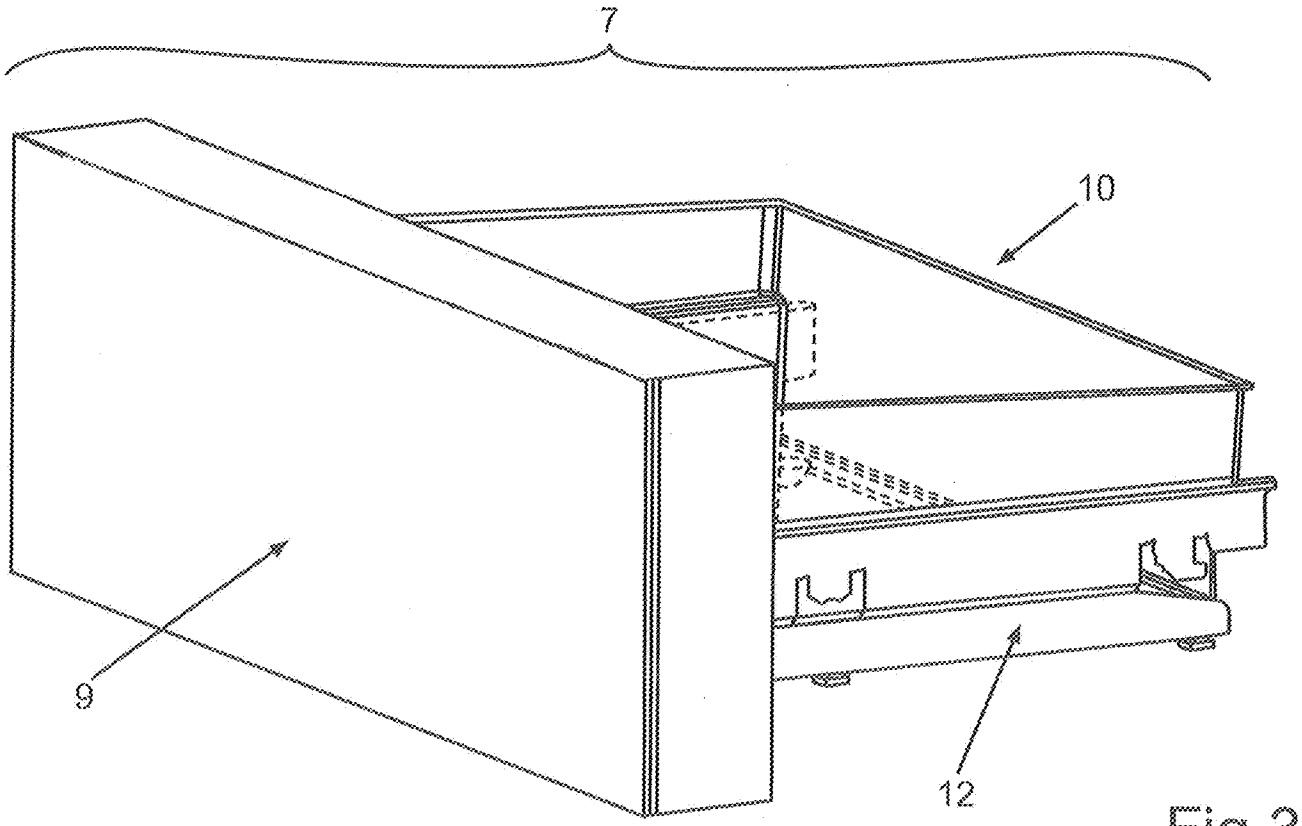
FIG. 3 is a perspective view of an extension device with a container of the domestic refrigeration appliance according to FIG. 1 and FIG. 2.

In FIG. 3 in a perspective view the extending carriage 7 is shown with the drawer 10 positioned in the storage position. When viewed from the front the drawer 10 is fully concealed by the door 9.

Figure 4:
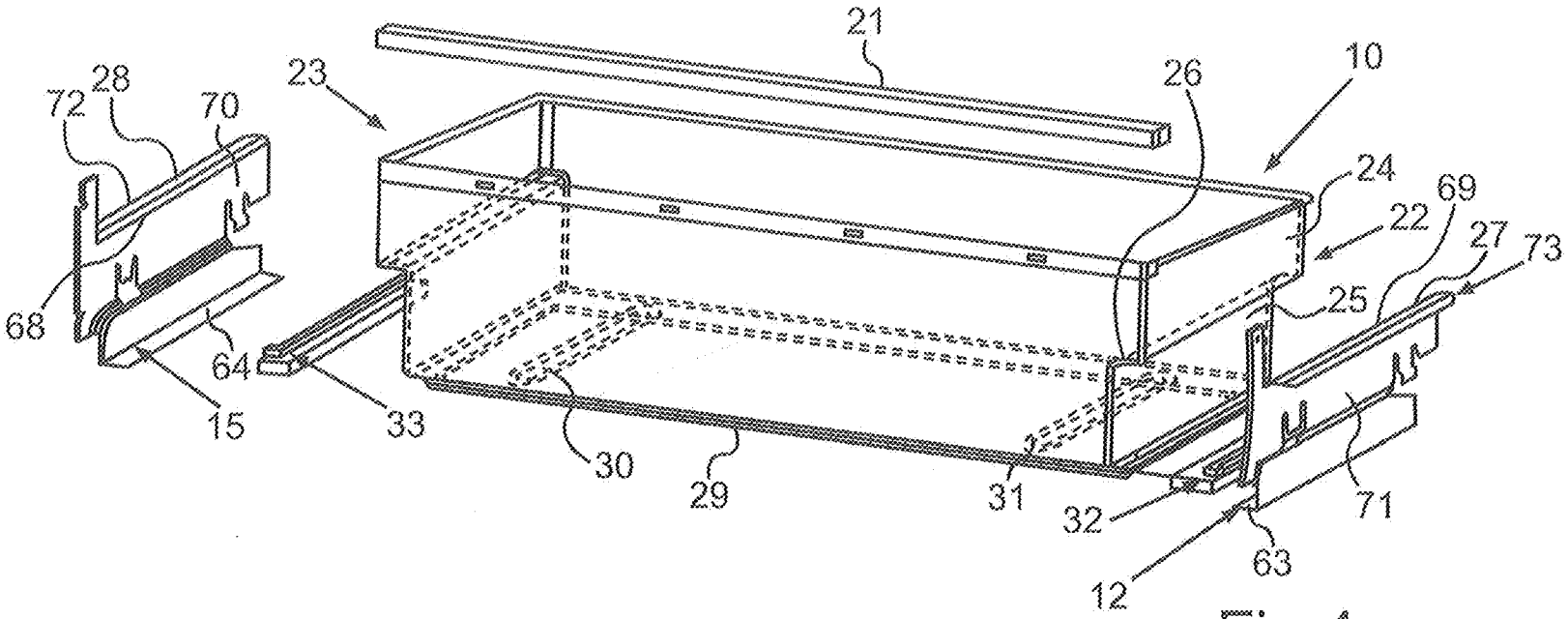
FIG. 4 is an exploded, perspective view of components of the view in FIG. 3.

In FIG. 4 the view of partial components of the view in FIG. 3 is shown in an exploded view. The drawer 10 is configured as an integral plastics container on which, for example, a front strip 21 may be arranged.

As may be identified, in this case the drawer 10 has two opposing vertical side walls 22 and 23. The side wall 22 comprises an upper wall portion 24 and a lower wall portion 25 viewed in the vertical direction. The two wall portions 24 and 25, viewed in the width direction of the domestic refrigeration appliance 1, are configured so as to be offset to one another, wherein to this end a discrete step 26 is configured approximately halfway up the side wall 22. Viewed in the width direction, the upper wall portion 24 is thus arranged offset further to the outside than the lower wall portion 25. An embodiment of the opposing side wall 23 is also analogous.

In one advantageous embodiment, in the mounted state the drawer 10 is located on guide elements 27 and 28 of the retaining elements 12, 15, wherein it is precisely on these steps that the drawer 10 is positioned on these guide elements 27 and 28. The guide elements 27 and 28 are outwardly bent webs and/or wings. The guide elements 27 and 28 are oriented outwardly from the upper edges 68 and 69 from respective plate-shaped base parts 70 and 71 of the retaining elements 12 and 15.

It may also be identified that webs and/or positioning runners 30 and 31 are integrally formed on a base and/or a lower face 29 of the drawer 10, the webs and/or positioning runners extending downwardly from this lower face 29.

Moreover, in FIG. 4 carrier rails 32 and 33 which are associated with the extension device and thus the extending carriage 7 are also shown, the carrier rails preferably being integral plastics components. These carrier rails 32 and 33 are separate components from the retaining elements 12 and 15. The retaining elements 12 and 15 are preferably configured from metal and also designed, in particular, integrally.

Figure 5:
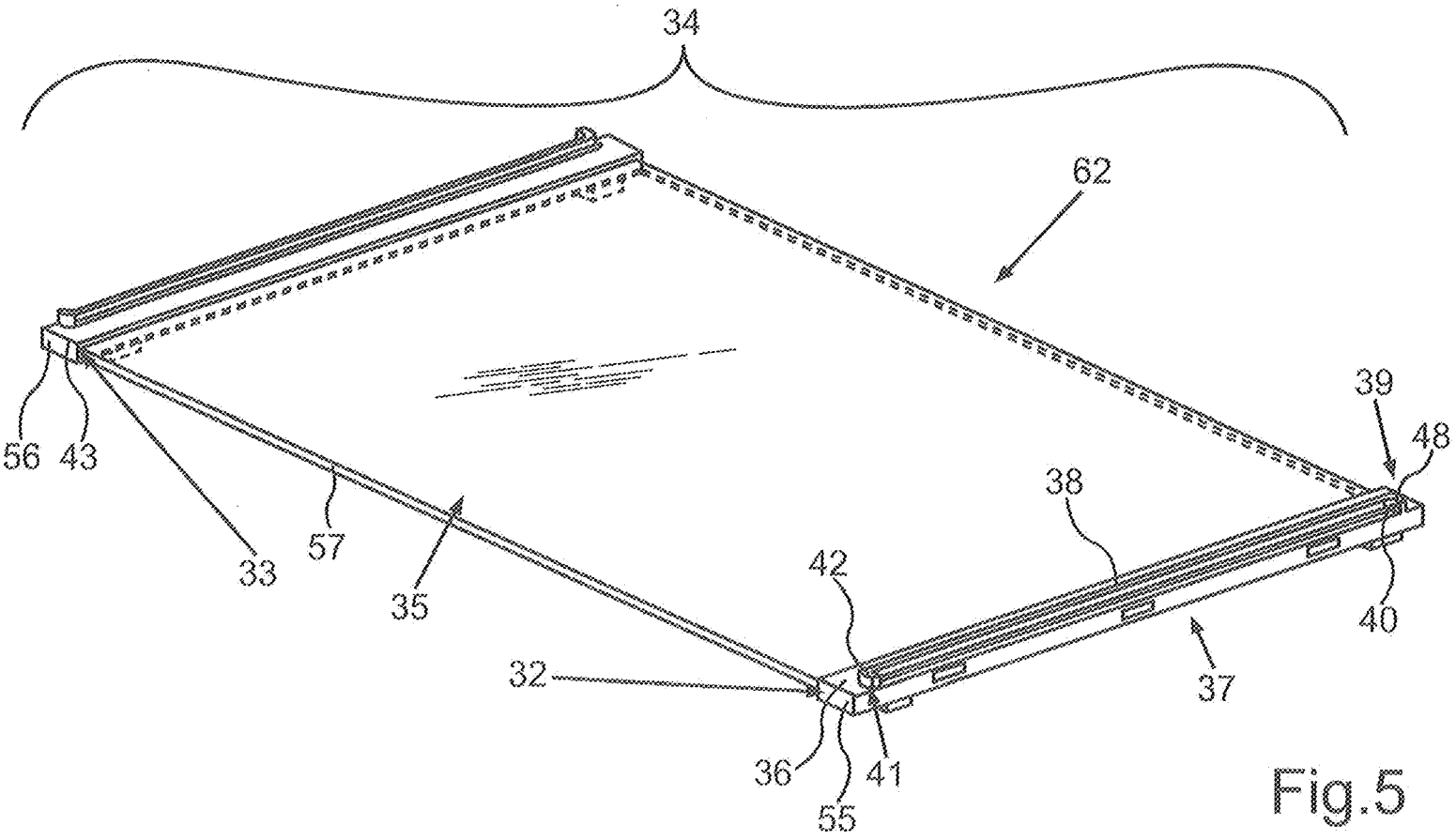
FIG. 5 is a perspective view of an exemplary embodiment of partial components of the extension device according to FIG. 3.

The carrier rails 32 and 33 are components of a carrier tray and/or tray 34 which is shown in FIG. 5 in a perspective view and which is preferably present in the exemplary embodiment. The tray 34 contains in addition to the carrier rails 32 and 33 a support plate 35 which, in particular, is a glass plate but may also be a plastics plate or metal plate. The carrier rails 32 and 33 extend in the depth direction over the entire extent of the support plate 35 and thus preferably are also rims of the support plate 35 on the edge side. A base plate 62, in particular of a support cage 61 (FIG. 6), is formed by means of the support plate 35 and the carrier rails 32 and 33, the drawer 10 being able to be installed thereon. The carrier rails 32 and 33 encompass the support plate 35 on opposing edges so that they also represent impact protection. The carrier rails 32 and 33 also form the mechanical coupling elements relative to the retaining elements 12 and 15.

A receiver cage and/or the support cage 61 for the drawer 10 is formed by the base plate 62, which has the support plate 35 and the carrier rails 32 and 33, and the retaining elements 12 and 15. This support cage 61 is suspended on the extension rails 11 separate therefrom.

As may be identified in FIG. 5, a sliding guide 37 is configured for guiding the drawer 10 on an upper face 36 of the carrier rail 32 facing the drawer 10. The sliding guide 37 is configured to be open upwardly in the vertical direction and thus in the y-direction. It is also configured to be open to the side and thus to the adjacent vertical side wall of the internal container 5 in the width direction and thus in the x-direction. The sliding guide 37 has a defining wall and/or sliding guide wall 38 which rises upwardly from the upper face 36 and is configured to extend in a straight line in the depth direction. A coupling recess 40 which is open toward the front but is closed upwardly in the vertical direction is configured on a rear end 39 in the depth direction. The coupling recess 40 is preferably integrated in the sliding guide 37 which, in particular, means that the walls defining the coupling recess 40, namely a rear wall 51 (FIG. 8) and a top wall 48, merge integrally with the sliding guide wall 38. In the exemplary embodiment shown the coupling recess 40 thus also represents, in particular, the rear end 39 of the sliding guide 37.

An extension stop element 42 is configured on a front end 41 of the sliding guide 37, the extension stop element, in particular, being a stop projection oriented in the width direction. In the exemplary embodiment this extension stop element 42 defines the sliding guide 37 to the front and also merges integrally with the sliding guide wall 38.

Accordingly, a corresponding design with a sliding guide and corresponding coupling recess and corresponding extension stop element is also implemented in the further carrier rail 33 on an upper face 43 facing the drawer 10, as is configured on the carrier rail 32 and has been described.

Thus it is preferably provided that the coupling recess 40, the sliding guide 37 and the extension stop element 42 are configured in a carrier rail 32, 33, in particular are integrated therein.

Figure 6:
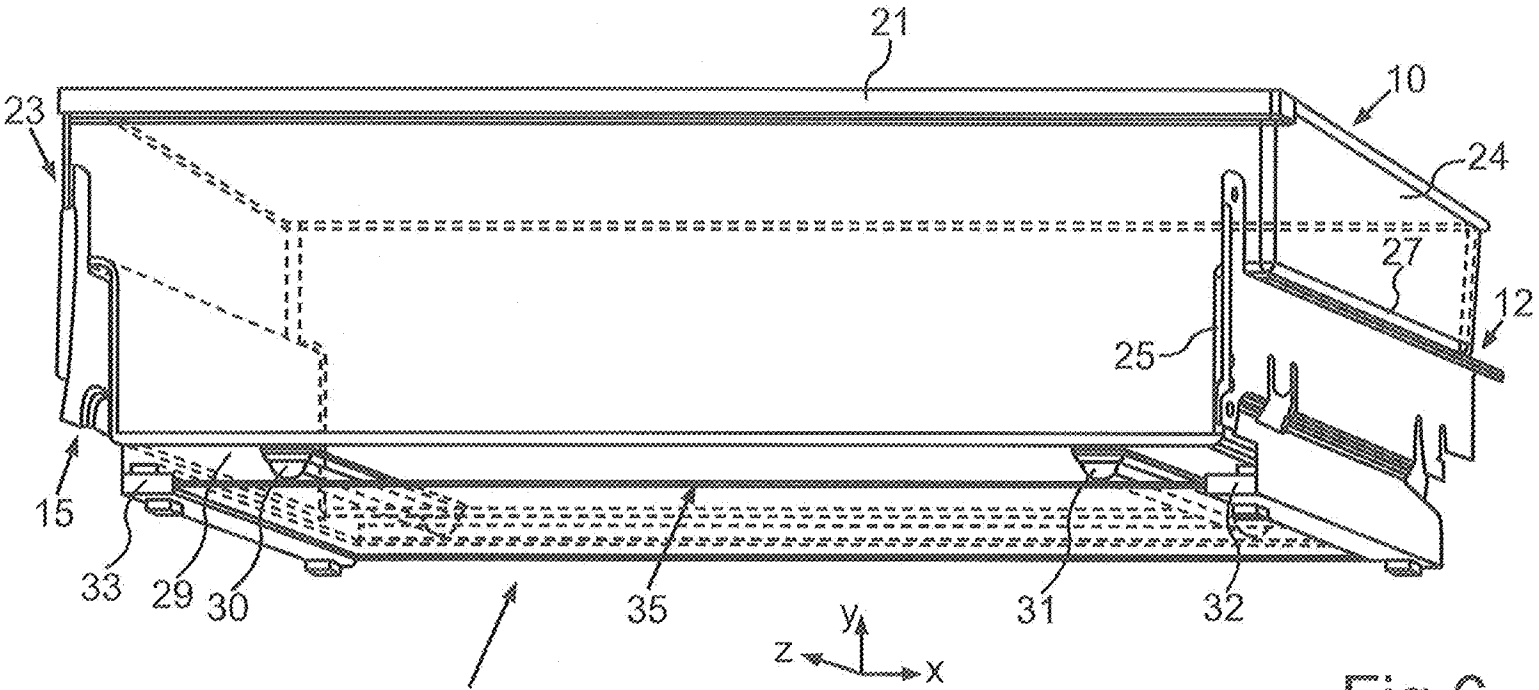
FIG. 6 is a perspective view of partial components of the extension device according to FIG. 3 with a container positioned thereon.

In FIG. 6 the assembled state of the components according to FIG. 4 and FIG. 5 is shown. Here it may be identified that the positioning runners 30 and 31 are directly positioned on an upper face of the support plate 35.

Figure 7:
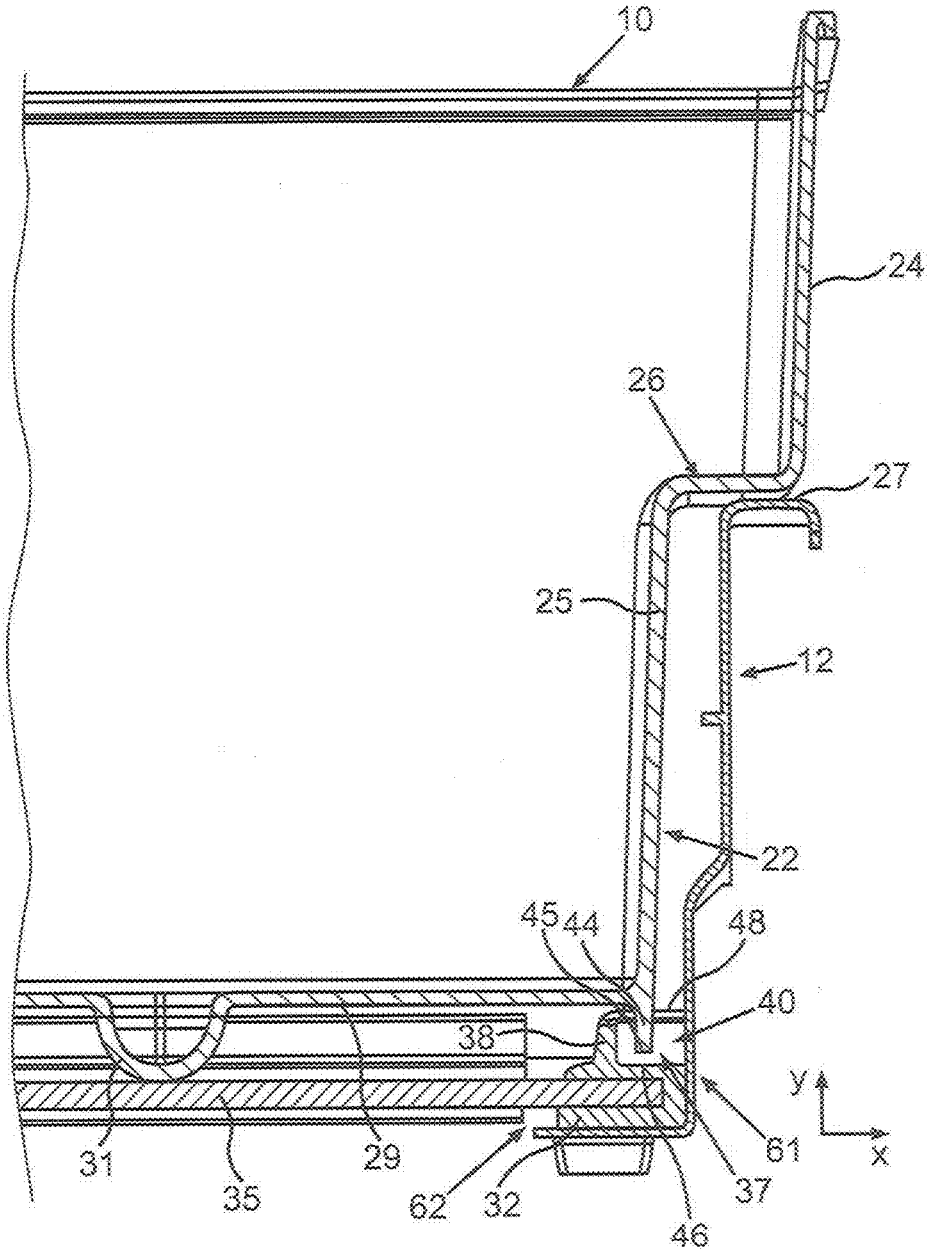
FIG. 7 is a sectional view of the view in FIG. 6 in a partial region of the view of FIG. 6.

In FIG. 7 the view according to FIG. 6 in a vertical sectional view in the x-, y-plane is shown, wherein in FIG. 7 only a partial detail of FIG. 6 is shown. As is shown here, a lateral edge of the support plate 35 is enclosed by the carrier rail 32 so that a certain degree of edge protection is also formed thereby.

It may be identified that a stop 44 is integrally formed on the lower face 29, in particular on a transition between the lower face 29 and the side wall 22, the stop extending downwardly on the lower face 29. The stop 44 is configured, in particular, as an elongated runner and preferably extends in a straight line in the depth direction. As may be identified in FIG. 7, it penetrates the sliding guide 37 from above. In the embodiment shown here, an essential point is seen to be that a lower edge 45 of this stop 44 in the vertical direction and thus in the y-direction is arranged spaced apart from the extension device and/or the extending carriage 7 and, in particular, from the carrier rail 32 in turn, in particular, from an upper face 46 of a base defining the sliding guide 37. This contactless positioning permits a particularly smooth coupling of a coupling element 50, which is configured in one piece on the stop 45 (FIG. 8), to the coupling recess 40. As may also be seen in FIG. 7, viewed in the width direction, this stop 44 is spaced apart from the sliding guide wall 38 and is also arranged spaced apart from the retaining element 12.

In FIG. 7 the top wall 48 of the coupling recess 40 is also shown.

Figure 8:
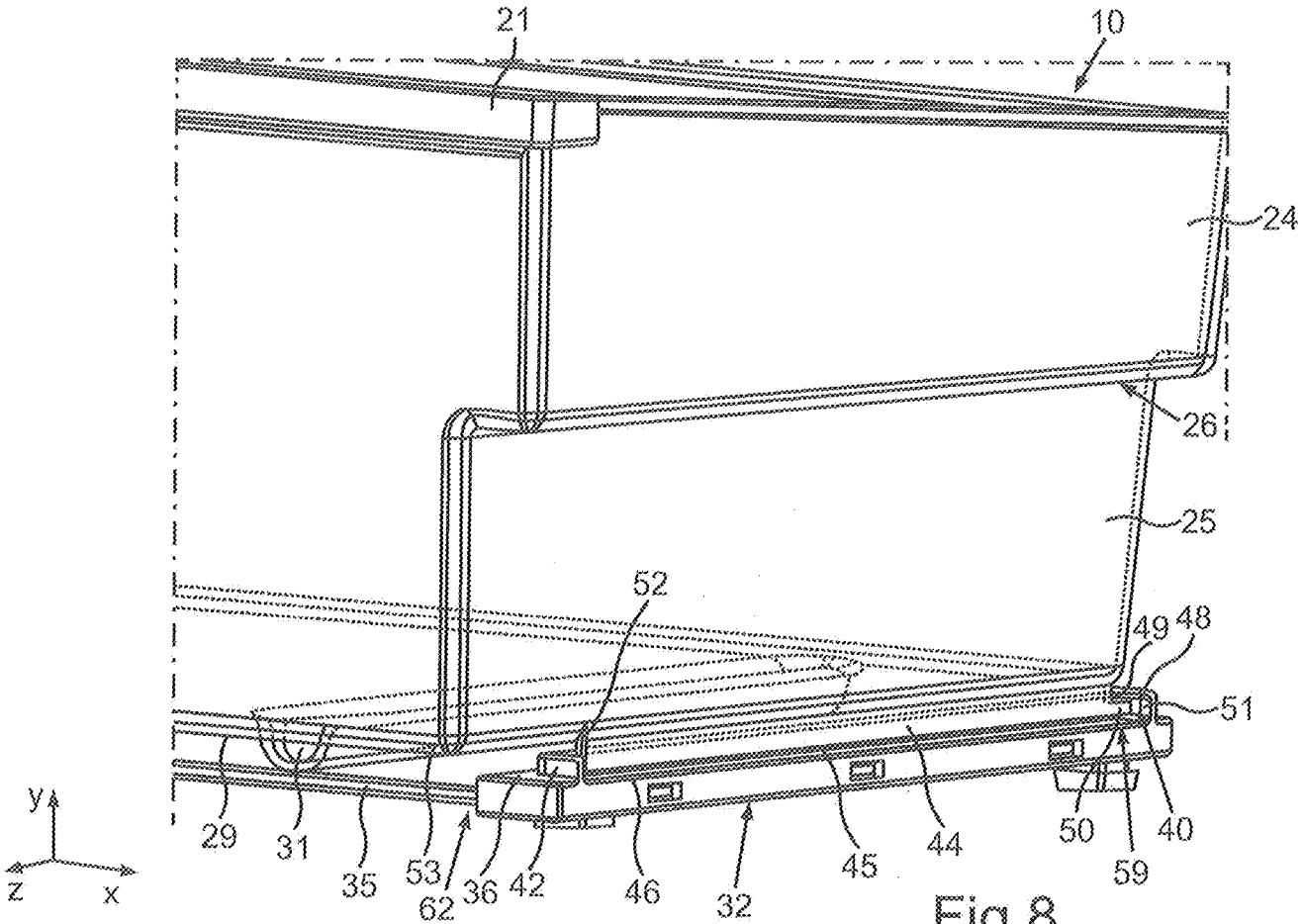
FIG. 8 is a perspective partial view of the components according to FIG. 5 with the container installed thereon.

In FIG. 8 a perspective view of the embodiments according to FIG. 6 and FIG. 7 is shown but without the retaining elements 12 so that a clearer view of the stop 44, the coupling recess 40 and the extension stop element 42 may be seen.

As may be identified in FIG. 8, the stop 44 extends to the rear end of the drawer 10. The coupling element 50 is integrally formed on a rear edge 49 of the stop 44, as has already been mentioned above. The coupling element 50 is, in particular, a coupling pin which is located to the rear in the depth direction and which in the storage position of the drawer 10, shown in FIG. 8, on the extension device and thus on the carrier rails 32 and 33 penetrates the coupling recess 14 and/or extends therein so that, viewed in the depth direction, the coupling element 50 overlaps the top wall 48. The coupling recess 40, as may be identified more clearly in FIG. 8, is defined by the rear wall 51 into which the top wall 48 merges.

Moreover, it may also be identified that a front end 52 of the stop 44 is offset to the rear relative to a front end 53 of the drawer 10 and thus in particular also the lower face 29.

Moreover, viewed in the vertical direction, the stop 44 is configured with a dimension such that in the storage position it overlaps level with the extension stop element 42 in order to achieve an effective extension stop in this connection.

Figure 9:
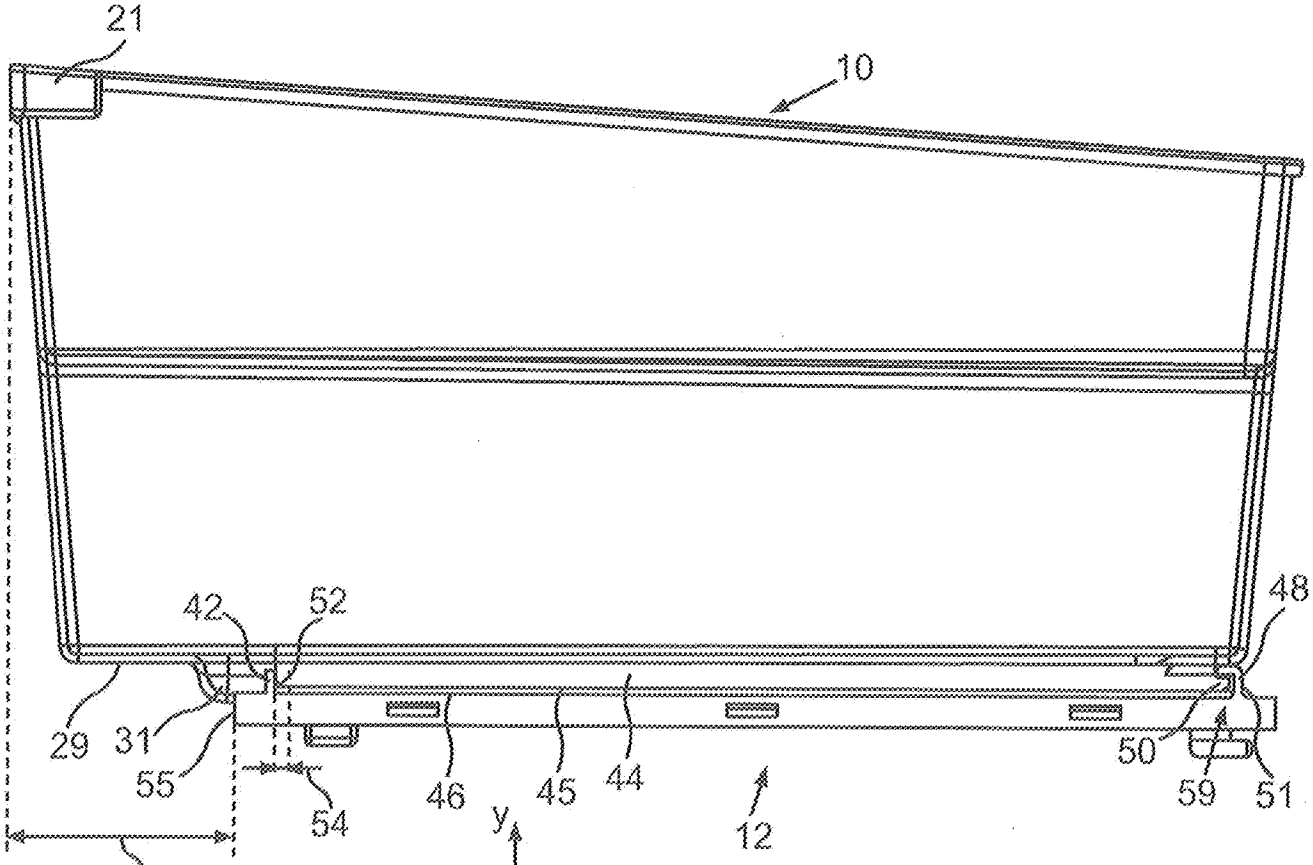
FIG. 9 is a side view of the view according to FIG. 8 with the drawer arranged in the storage position on the extension device.

In FIG. 9 a side view of the view in FIG. 8 is shown. Here it may be identified that in its storage position on the carrier rails 32 and 33 the drawer 10 is arranged with a clearance 54 in the depth direction. The clearance 54 therefore permits the possibility of relative movement between the drawer 10 and the extension device, in particular in the carrier rails 32 and 33, in this storage position of the drawer 10 which has been reached.

It is very advantageous, in particular, when the coupling element 50 and the coupling recess 40 are configured such that a penetration of the coupling element 50 in the coupling recess 40 is achieved over the entire movement path of the drawer 10 on the carrier rail 32 and the carrier rail 33. This means that the coupled state between the coupling element 50 and the coupling recess 40 is maintained over the entire clearance 54. This is particularly advantageous since a simple removal of the drawer 10 from the carrier rails 32 and 33 and a simple positioning onto the carrier rails 32 and 33 is permitted but also with this possibility of relative movement an undesired tilting of the drawer 10 about an axis oriented in the width direction is prevented. It is particularly advantageous if, as may be seen clearly in FIGS. 9 and 10, the drawer 10 viewed in the depth direction extends beyond a front end 55 (FIG. 5) of the carrier rail 32 and a front end 56 (FIG. 5) of the carrier rail 33 and over a front edge 57 (FIG. 5) of the support plate 35, so that between a maximum front point of the drawer 10 and the edge 57 a spacing 47 is produced in the depth direction. As a result a gap 60 (FIG. 2) is formed toward the inner face 13 and the unhindered flow of the airflow 20 is achieved.

Figure 10:
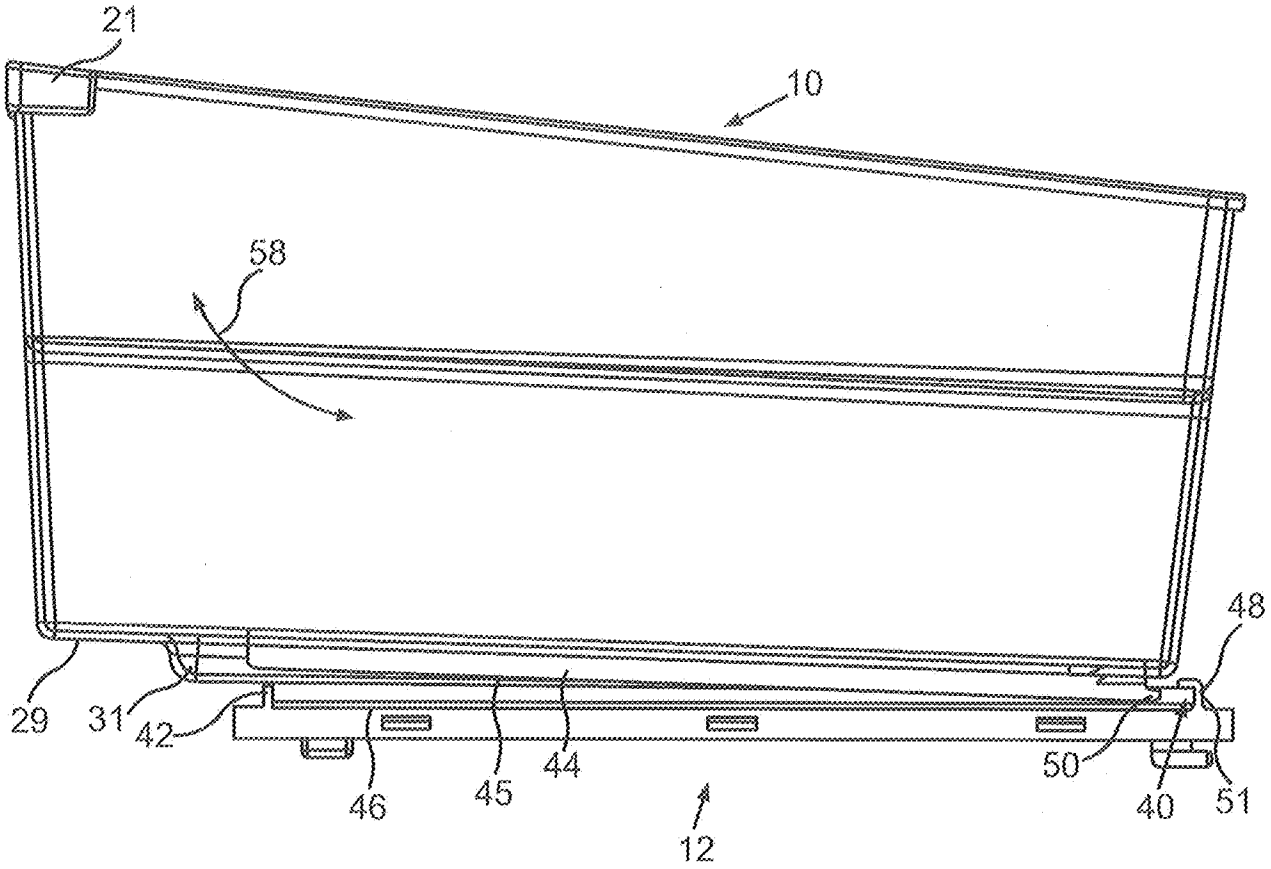
FIG. 10 is a side view according to FIG. 9 with the drawer which has been partially removed from the extension device and which thus has been removed from the storage position by an at least partial upward pivoting movement.

In FIG. 10, a state of the drawer 10 removed from the storage position is shown for further clarification. By means of the clearance 54 it is possible in this connection to raise the drawer 10 in a simple manner by an indicated pivoting movement 58 upwardly from the carrier rails 32 and 33 and then to release the coupled state of the tilt protection device 59, which is formed by the coupling element 50 and the coupling recess 40, and/or to release the tilt protection state.

Figure 11:
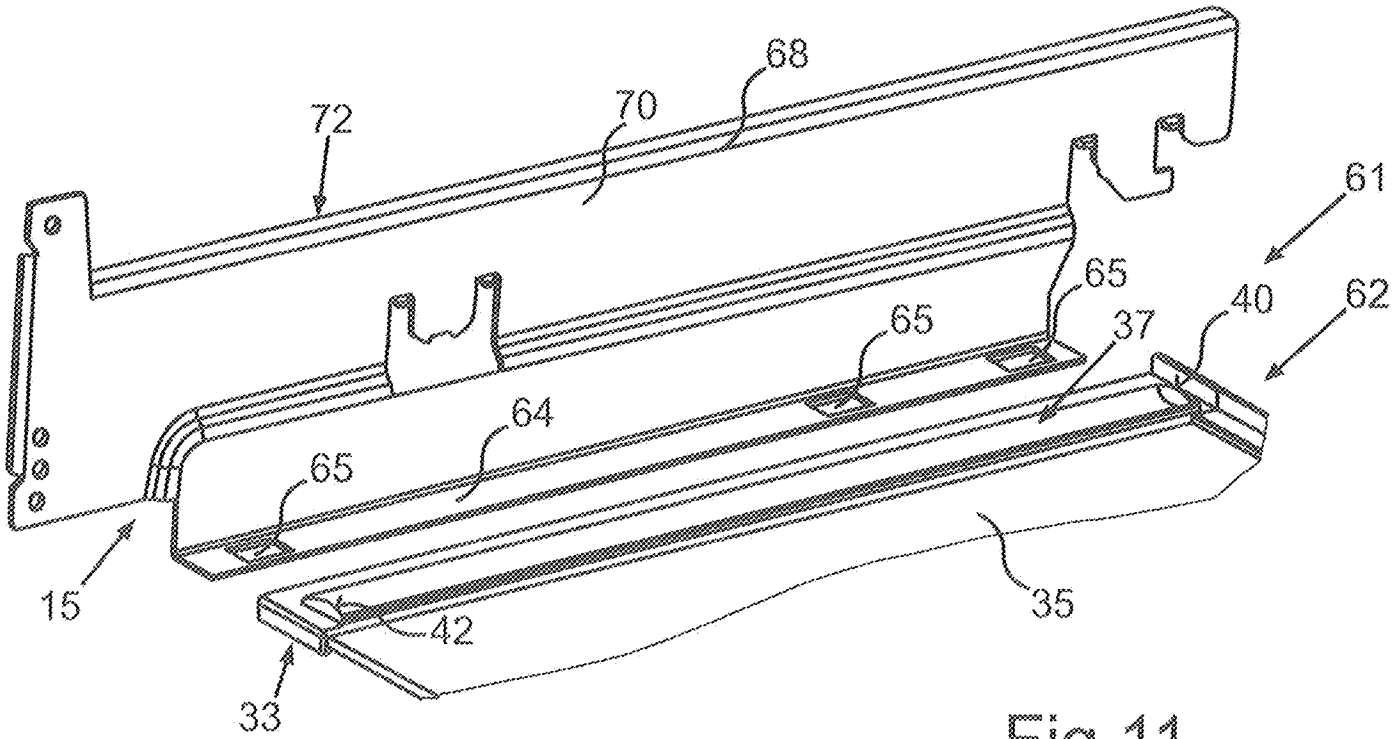
FIG. 11 is a perspective view of the dismantled partial components of a support cage of the extension device.

In FIG. 11 in a perspective view the support cage 61 is shown in an exemplary embodiment with partial components which are shown dismantled. The base plate 62 in this case is separated from the retaining element 15, wherein the connection between the base plate 62 and the retaining element 15 is releasable in a non-destructive manner. The retaining element 15 is shown with its plate-shaped base part 70. A horizontally inwardly protruding support web 64 is bent inwardly on the lower edge opposing an upper edge 68, the carrier rail 33 in the assembled state being positioned on said support web. As may be identified, in the exemplary embodiment not only one receiver 65 but a plurality of such receivers 65 are formed in this support web 64, the receivers being configured here as through-holes, in particular being provided with an angled hole contour. In the assembled state the coupling elements 66 (FIG. 13) which are integrally formed on a lower face 67 of the carrier rail 33 engage in these receivers 65. A plug connection which is releasable in a non-destructive manner is then formed between these coupling elements 66 and the receivers 65. In particular, the coupling elements 66 are adapted in their external geometry to the geometry of the receiver 65 so that, in particular, an accurate insert and thus an accurate introduction of the coupling elements 66 into the receivers 65 is permitted. The retaining element 12 and the support web 63 are correspondingly configured.

Figure 12:
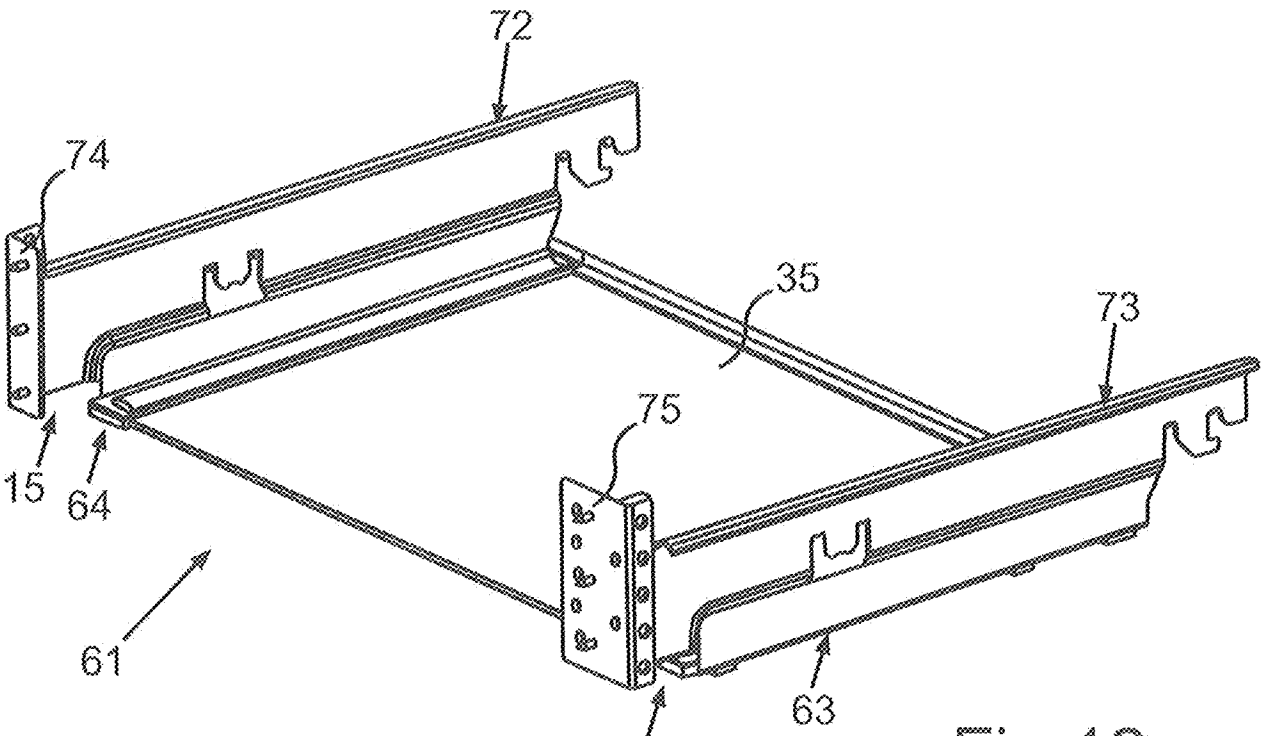
FIG. 12 is a perspective view of the support cage according to FIG. 11 in the assembled state.

As may be identified, according to the assembled view of the support cage 61 in FIG. 12, the retaining elements 12 and 15 are arranged on opposing sides of the base plate 62, viewed in the width direction and thus in the x-direction. Due to their plate-like design, the retaining elements 12 and 15, in particular the base parts 70 and 71 thereof may then also be configured as lateral cage walls and thus as lateral rims of the support cage 61. The retaining elements 12 and 15 are configured as suspension elements for the releasable suspension of the support cage 61 in a non-destructive manner on extension rails 11 of the extension device separate from the support cage 61. In particular, the suspension webs 72 and 73 are provided to this end, said suspension webs being configured in a vertical sectional view and thus in an x-, y-plane in the manner of a groove and thus forming a downwardly open groove. This groove may be configured, for example, as an inverted U-shape. The guide elements 27 and 28 are configured in this connection specifically in the manner of these suspension webs 72 and 73 with their specific geometry.

Figure 13:
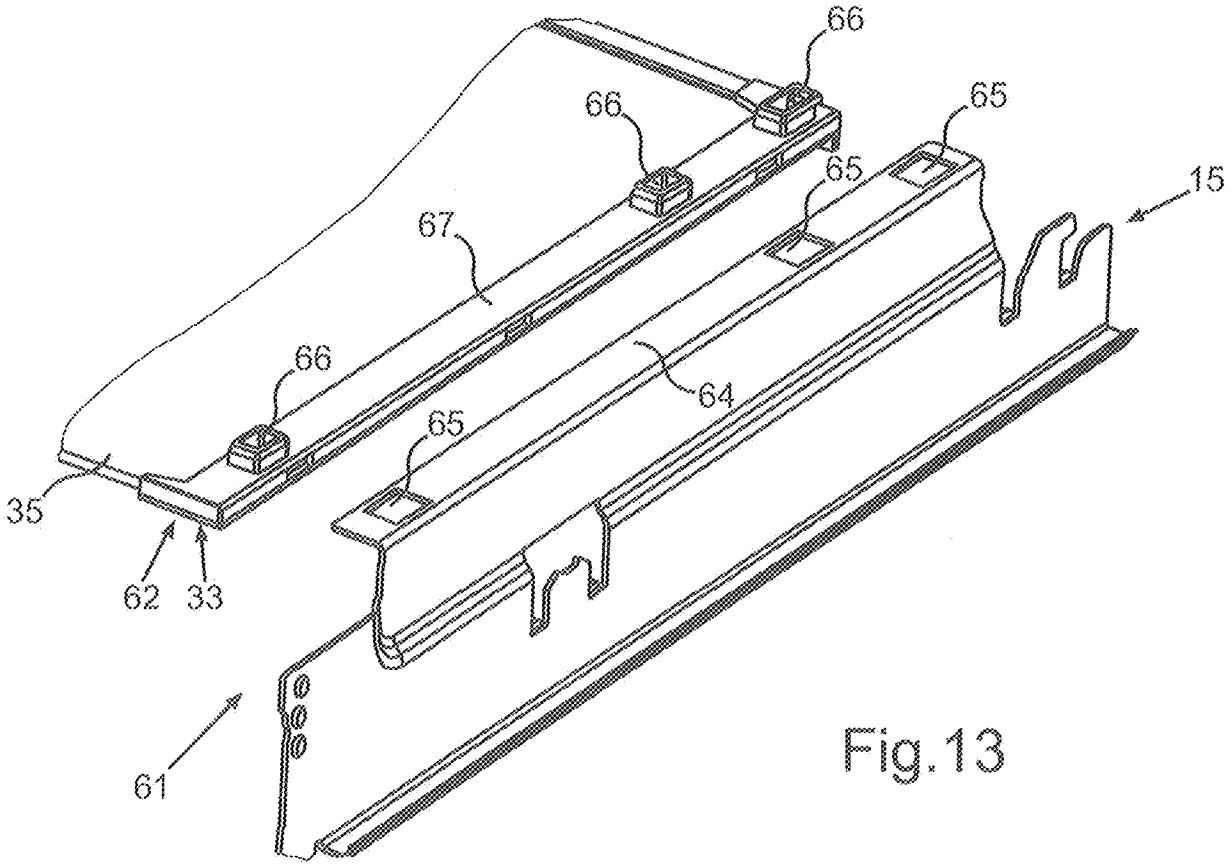
FIG. 13 is a perspective view of the partial components according to FIG. 11 with a view from below.

As in particular may be identified in FIG. 11 to FIG. 13, the support cage 61 is configured to be open in the depth direction and thus viewed from the rear, which means that it has no rear wall. The support cage 61 is defined on the front face by the door 9 which thus may also be viewed as the front wall of the extending carriage 7. In FIG. 12, the door 9 is not shown but is fastened to additional front flanges 74 and 75, in particular screwed on. These front flanges 74 and 75 may be separate parts but may also be integrated in the retaining elements 12 and 15.

With regard to the suspension of the retaining elements 12 and 15 on the extension rails 11, in particular on the running rails thereof, it may also be provided that corresponding engagement elements are coupled with receivers, so that an engagement and/or toothed connection in the vertical direction is present between a retaining element 12, 15 and an extension rail 11, so that a coupling of the movement between these components is provided in the depth direction when pushed in and out.

Figure 14:
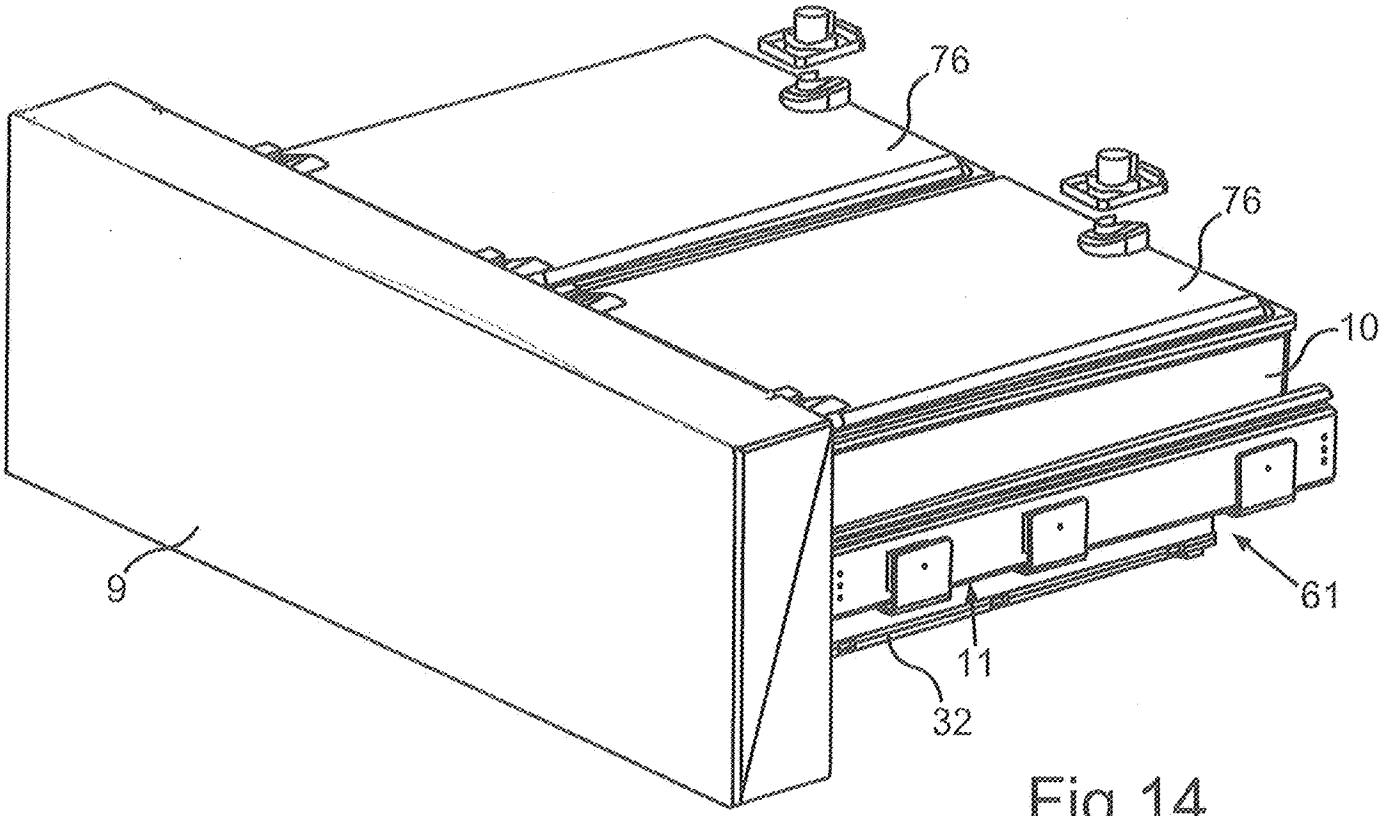
FIG. 14 is a perspective view of a further exemplary embodiment in which the container is configured as a keep-fresh container.
Figure 15:
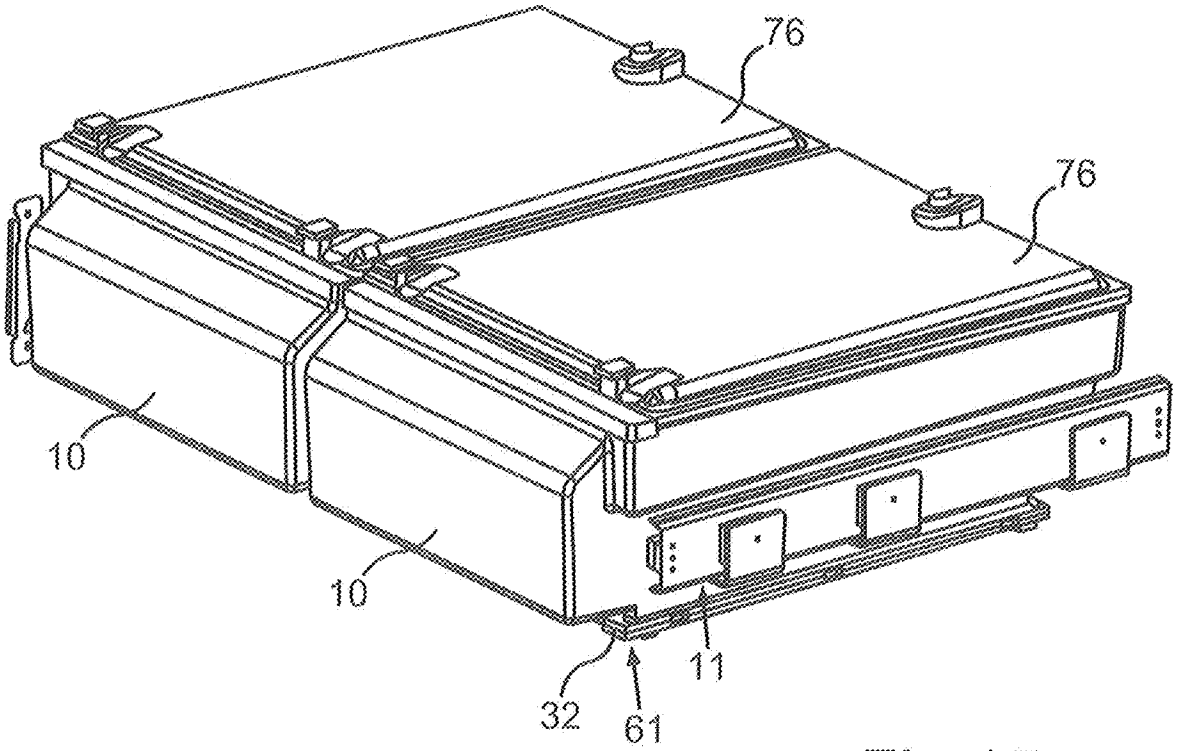
FIG. 15 is a perspective view according to FIG. 14 in which a door of the extending carriage has been removed.

In FIG. 14, a further exemplary embodiment is shown in a perspective view in which two separate drawers 10 are arranged on the support cage 61. Here the containers also have in each case a cover 76 in addition to the drawers 10. The containers in this case are keep-fresh containers in which an individual ambient humidity which is different from the remaining volume of the receiver space 6 is able to be adjusted by means of a humidifying device, not shown, of the domestic refrigeration appliance 1. To this end, the humidifying device has, in particular, a misting unit, for example a piezo mister, by which liquid, in particular water, is misted from a tank of the humidifying device and is then introduced as fluid mist into a keep-fresh container via a fan. The cover 76 in each case is able to be raised and lowered via an actuating mechanism. In FIG. 15, the embodiment according to FIG. 14 is shown without the door 9.

In FIG. 14 and FIG. 15, shown merely by way of example in terms of local attachment and number, three plate-shaped attachment flanges are provided in the region of the extension rail 11, the flanges being provided for fastening the extension rail 11 to a vertical side wall of the internal container.

The following is a summary list of reference numerals and the corresponding structure used in the above description of the invention:

1 Domestic refrigeration appliance
2 Housing
3 Door
4 Door
5 Internal container
6 Second receiver space
7 First extending carriage
8 Second extending carriage
9 Door
10 Drawer
11 Extension rail
12 Retaining element
13 Inner face
14 Drawer
15 Retaining element
16 Module
17 Evaporator
18 Fan
19 Housing
20 Airflow
21 Front strip
22 Side wall
23 Side wall
24 Wall portion
25 Wall portion
26 Step
27 Guide element
28 Guide element
29 Lower face
30 Positioning runner
31 Positioning runner
32 Carrier rail
33 Carrier rail
34 Tray
35 Support plate
36 Upper face
37 Sliding guide
38 Defining wall
39 Rear end
40 Coupling recess
41 Front end
42 Extension stop element
43 Upper face
44 Stop
45 Stop
46 Upper face
47 Spacing
48 Top wall
49 Rear edge
50 Coupling element
51 Rear wall
52 Front end
53 Front end
54 Clearance
55 End on front face
56 End on front face
57 Edge on front face
58 Pivoting movement
59 Tilt protection device
60 Gap
61 Support cage
62 Base plate
63 Supporting web
64 Supporting web
65 Receiver
66 Coupling element
67 Lower face
68 Edge
69 Edge
70 Base part
71 Base part
72 Suspension web
73 Suspension web
74 Front flange
75 Front flange
76 Cover

The invention claimed is:

1. A domestic refrigeration appliance, comprising:

an internal container having walls defining a receiver space for food;

an extension device disposed on said internal container and is able to be pushed into and pulled out of said receiver space relative to said internal container;

a container for receiving the food and is able to be removably positioned on said extension device; and said extension device having extension rails and a support cage for said container, said support cage, viewed in a width direction of the domestic refrigeration appliance, having a base plate and retaining elements disposed on said base plate on opposing sides and separate from said base plate as lateral cage walls, said base plate being releasably connected in a non-destructive manner to said retaining elements, wherein said retaining elements are configured as suspension elements for a releasable suspension in a non-destructive manner of said support cage on said extension rails of said extension device which are separate from said support cage.

2. The domestic refrigeration appliance according to claim 1, wherein when viewed in a depth direction of the domestic refrigeration appliance, said support cage is configured so as to be open to a rear.

3. The domestic refrigeration appliance according to claim 1, wherein said base plate and said retaining elements have interlocking plug connections, said base plate being connected to said retaining elements by said interlocking plug connections.

4. The domestic refrigeration appliance according to claim 1, wherein said retaining elements each have a supporting web, said base plate being positioned on said supporting web.

5. The domestic refrigeration appliance according to claim 1, wherein said extension device is configured as an extending carriage having a door, said retaining elements being disposed on said extending carriage and protruding to a rear on an inner face of said door facing said receiver space, and said container being mounted on said retaining elements.

6. The domestic refrigeration appliance according to claim 5, wherein a gap is formed between said inner face of said door and a front end of said base plate facing said inner face.

7. The domestic refrigeration appliance according to claim 1, wherein said container is a keep-fresh container in which an ambient humidity which is different from said receiver space is able to be adjusted by a humidifying device of the domestic refrigeration appliance.

8. A domestic refrigeration appliance, comprising:

an internal container having walls defining a receiver space for food;

an extension device disposed on said internal container and is able to be pushed into and pulled out of said receiver space relative to said internal container;

a container for receiving the food and is able to be removably positioned on said extension device; and said extension device having extension rails and a support cage for said container, said support cage, viewed in a width direction of the domestic refrigeration appliance, having a base plate and retaining elements disposed on said base plate on opposing sides and separate from said base plate as lateral cage walls, wherein said retaining elements are configured as suspension elements for a releasable suspension in a non-destructive manner of said support cage on said extension rails of said extension device which are separate from said support cage;

said retaining elements each having a supporting web, said base plate being positioned on said supporting web said supporting web having at least one receiver formed therein;

said base plate having a lower face with a coupling element penetrating said receiver for connecting to said retaining element.

9. The domestic refrigeration appliance according to claim 8, wherein said base plate is of multipart configuration and contains a support plate and carrier rails, said carrier rails, viewed in the width direction of the domestic refrigeration appliance, are connected to said support plate on opposing sides of said support plate.

10. The domestic refrigeration appliance according to claim 9, wherein:

said carrier rails have an upper face, said upper face having a coupling recess formed therein; and said container has a rear region with a coupling element which engages in said coupling recess configured on said extension device, so that a tilt protection device is configured for said container.

11. The domestic refrigeration appliance according to claim 10, wherein:

said container has a stop;

said extension device has a sliding guide configured to be open upwardly and also toward a vertical wall of said internal container, and in a storage position of said container on said extension device said stop of said container is engaged from above and is guided in said sliding guide; and said sliding guide is configured so as to be integrated on said upper face of said carrier rail.

12. The domestic refrigeration appliance according to claim 11, wherein said coupling recess is integrated in said sliding guide.

13. The domestic refrigeration appliance according to claim 11, wherein said coupling recess is integrated in a rear end of said sliding guide.

14. The domestic refrigeration appliance according to claim 10, wherein said lower face is a lower face of said carrier rail.

15. A domestic refrigeration appliance, comprising:

an internal container having walls defining a receiver space for food;

an extension device disposed on said internal container and is able to be pushed into and pulled out of said receiver space relative to said internal container;

a container for receiving the food and is able to be removably positioned on said extension device; and said extension device having extension rails and a support cage for said container, said support cage, viewed in a width direction of the domestic refrigeration appliance, having a base plate and retaining elements disposed on said base plate on opposing sides and separate from said base plate as lateral cage walls, wherein said retaining elements are configured as suspension elements for a releasable suspension in a non-destructive manner of said support cage on said extension rails of said extension device which are separate from said support cage;

said retaining elements including a plate-shaped base part having an upper edge with an outwardly oriented suspension web for suspending said retaining elements on said extension rails.

* * * * *